US007603947B2

(12) United States Patent
Hanzel

(10) Patent No.: US 7,603,947 B2
(45) Date of Patent: Oct. 20, 2009

(54) PRINTING DEVICE FOR PRINTING MARKINGS ONTO INSULATED ROUND WIRES

(76) Inventor: Eleonore Hanzel, Schoene Aussicht 16, 34359 Reinhardshagen (DE)

( * ) Notice: Subject to any disclaimer, the term of this patent is extended or adjusted under 35 U.S.C. 154(b) by 0 days.

(21) Appl. No.: 12/099,917

(22) Filed: Apr. 9, 2008

(65) Prior Publication Data

US 2008/0250949 A1 Oct. 16, 2008

(30) Foreign Application Priority Data

Apr. 11, 2007 (DE) ..... 10 2007 017 469
Mar. 19, 2008 (DE) ..... 10 2008 015 085

(51) Int. Cl.
*B41F 16/00* (2006.01)
*B41F 17/10* (2006.01)

(52) U.S. Cl. ..... 101/33; 101/44; 101/35

(58) Field of Classification Search ..... 101/33, 101/34, 44, 35; 156/240; *B41F 16/00, 17/08, B41F 17/10, 17/28, 17/30, 17/20*
See application file for complete search history.

(56) References Cited

U.S. PATENT DOCUMENTS 2,925,773 A * 2/1960 Kingsley ..... 101/11
3,052,180 A * 9/1962 Ackerman et al. ..... 101/9
3,196,780 A * 7/1965 Ternovits et al. ..... 101/10
3,813,268 A * 5/1974 Kerwin ..... 156/238

FOREIGN PATENT DOCUMENTS

DE 4312553 A1 * 10/1994
JP 11070679 A * 3/1999

* cited by examiner

*Primary Examiner*—Leslie J Evanisko
(74) *Attorney, Agent, or Firm*—Michael J. Striker

(57) ABSTRACT

A printing device for printing markings directly onto insulated round wires is presented. The printing device includes a printing module (1, 2) that prints the markings onto a retransfer film (7) as transfer carrier and a transport device (9, 13, 24) transports the retransfer film (7) into the transfer device (9, 13, 24) for transfer printing of the marking onto the round wires (16). The transfer device (9, 13, 24) includes two die halves (4, 5) with a plurality of semicircular grooves (3) for wires (16) of different diameters. A lower die half (5) is configured to receive the wires (16) while an upper die half (4) is configured with heater (12) to heat and enclose the wire (16) with the retransfer film (7) bearing the marking. The two die halves (4, 5) are joined under pressure and heat around the wire (16) to be printed on.

11 Claims, 4 Drawing Sheets

PRINTING DEVICE FOR PRINTING MARKINGS ONTO INSULATED ROUND WIRES

BACKGROUND OF THE INVENTION

The invention relates to a printing device for printing markings onto the covering of an insulated wire.

A plurality of different wires are used as connecting elements between structural elements or assemblies in electrical and electronic control systems. These wires are generally provided with an outer insulation made of plastic material. A plurality of the wires are insulated round wires with cross-sections selected in accordance with the current density and therefore with different diameters. The insulation is configured in different colours to optically divide into corresponding groups of the set.

It is additionally necessary to provide each individual wire with its own marking at both wire ends. These markings are usually defined in the design documents by the producer of the control system and enable fault-free and simple handling for production and further service. Depending on the number of control systems or devices produced, the wires are identified by means of appropriate organization forms and marking devices before wiring into the device. For regular production, complete sets of wires for assemblies or also for complete systems are created using an automatic marking and bundling technique. For this, the data are processed and prepared by means of electronic data processing using the design documents.

Automatic marking systems use technically complex inkjet printers using ink containing solvent for marking or printing. The inscription is applied partially around the surface of the wire.

A simpler method of marking used for smaller production quantities is to glue a self-adhesive label to the wire. The labels are printed on using standard thermal transfer printers and are then wound and glued around the wire.

In addition, the use of narrow thin plastic tags with two holes provided at the ends is known. These plastic tags are inscribed with the marking, e.g. by means of thermal transfer printing or written by hand. The wire is directed through the two holes one after the other, and the tag is thus fastened to the wire with the text outside.

It is additionally known to mark round wires by attaching tubes that are already preprinted with a letter or with a number or also laterally slotted tubes. In this method a plurality of individual tubes must be attached in succession on the wire to display the marking. Tubes with different diameters are used to correspond to the respective wire diameter.

A similar solution to this is to attach shrink tubing pieces to the wire. This marking method has the essential advantage over the use of individual tubes that each have one letter that the shrink tubing end can already be provided with the complete marking. The shrink tubing is printed on using a thermal transfer printer in a known manner.

All the specified marking processes, with the exception of the complex inkjet printing, do not print directly onto the wire insulation, but use an additional object that has an inscription and is then fastened to the wire in a suitable manner.

A further known printing process that enables direct printing onto the wire insulation uses punches and operates substantially using a hot stamping process. Stamping wheels adapted to the wire diameter and having preformed letters or numbers are inserted into the punches. Several stamping wheels are arranged on one punch and can be respectively adjusted by rotating so that a multiple-digit marking is created. The stamping wheels are heated to a correspondingly high temperature. When the punch is closed, the stamping wheels come into contact with the round wire to be printed on and transfer their contour directly onto the wire surface in colour by means of a standard hot stamping foil. The advantage with this technology is that the insulated wire surface is printed on directly. However, the handling is very complex because of the mechanical adjustment of each individual stamping wheel for each individual mark. Moreover, each stamping wheel has a fixed mark size and only a small and limited range of marks.

It is evident from the listed printing processes for printing on round wires that standard known printing techniques with their ease of printing cannot be used because of the round shape of the surface of the wires, since their application requires flat printing surfaces.

SUMMARY OF THE INVENTION

An object of this invention is, therefore, a printing device for easily printing markings onto insulated wires.

A further object of the invention is to configure the aforementioned printing device so that it can print any desired markings at predetermined locations of the wires.

Yet another object of the invention is to configure the printing device such that it can print markings onto the covering of a round wire avoiding complicated designs and handling.

These and other objects are solved in accordance with the present invention in that the printing device is a transfer device which contains a first die half with a first means to partially receive the wire, a second die half with a groove facing the first means and a heating device as well as means for moving the two die halves against one another, wherein the arrangement is such that after the wire is laid in the first means and when the two die halves are moved against one another under pressure and when heated by the heating device, a transfer carrier arranged between the wire and the second die half and provided with printed markings is laid at least partially around the covering of the wire and the markings are thereby transferred to the covering The invention provides the advantage that the markings can firstly be printed onto a transfer carrier that is held flat and can then be transferred to the rounded covering surfaces of the wires without problem because of the flexibility of said transfer carrier during the transfer process. An additional advantage is that commercially available thermal printers, which are generally provided with a standard commercial interface for connection to a computer that can be controlled by a keyboard, can serve to produce the transfer carrier. Therefore, the information for the markings to be printed can be transferred to the printer in a simple manner with a data processing device having a keyboard such as a laptop, for example. As a result, the printing device according to the invention can be configured as a comparatively small transportable device that can print on wires with different diameters and is simple to operate.

Further advantageous features of the invention are evident from the dependent claims.

The invention is explained in more detail below on the basis of preferred exemplary embodiments in association with the attached drawings.

DETAILED DESCRIPTION OF THE PREFERRED EMBODIMENTS

Figure 1:
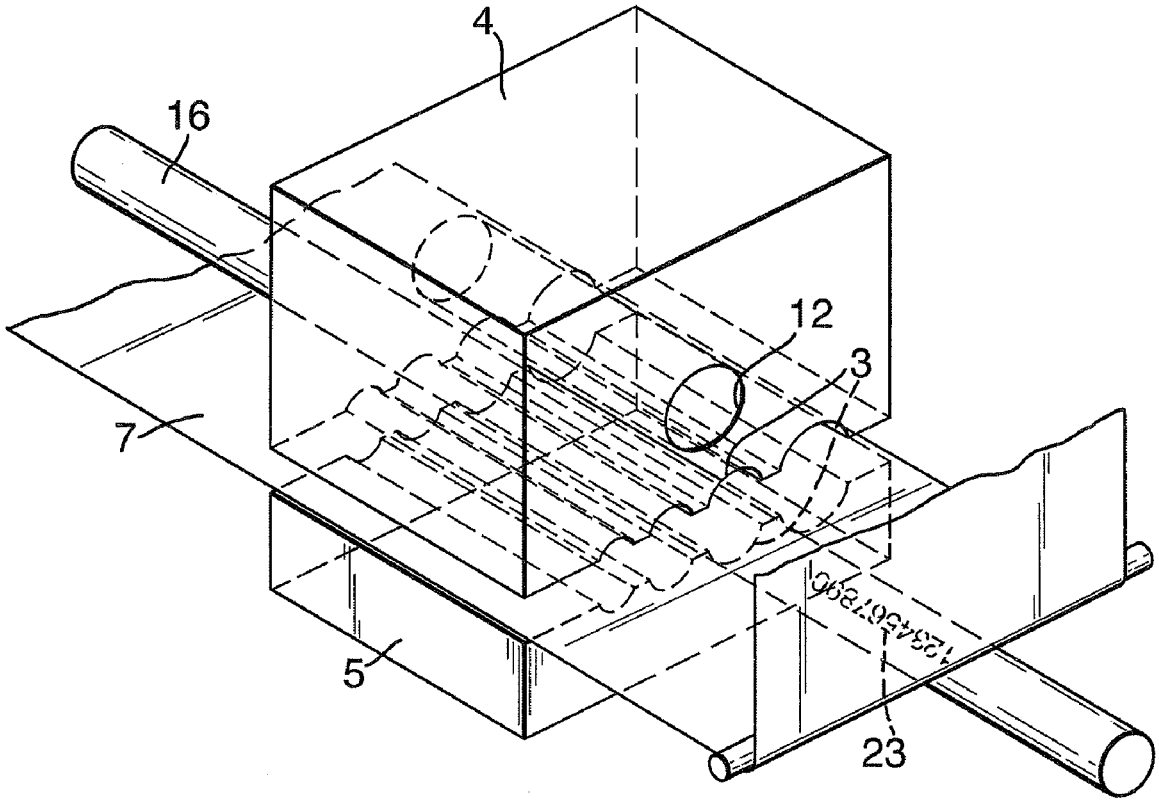
FIG. 1 shows the basic principle of the invention in a schematic perspective view.

FIG. 1 shows the principle of the invention of transfer printing onto round wires. A transfer device with die halves 4) and 5), a wire 16) and the contours enclosing this of grooves 3) configured in the upper die half 4) and the lower die half 5). The approximately semicircular grooves 3) run in the same direction as the wire to be printed on inserted therein. A plurality of grooves 3) with cross-section of different sizes are arranged next to one another and preferably parallel to one another. A wire to be printed on is held in a groove adapted to size in the lower die half 5). An already printed-on transfer carrier, preferably in the form of a retransfer film 7), is guided between the two die halves 4 and 5 above the wire 16), and from said transfer carrier a marking 23) is transferred onto the wire 16) when the upper die half 4) is moved downwards and the wire 16) is enclosed by the grooves 3. A bore 12), into which a heating system is inserted, is provided in the upper die half 5).

Figure 2:
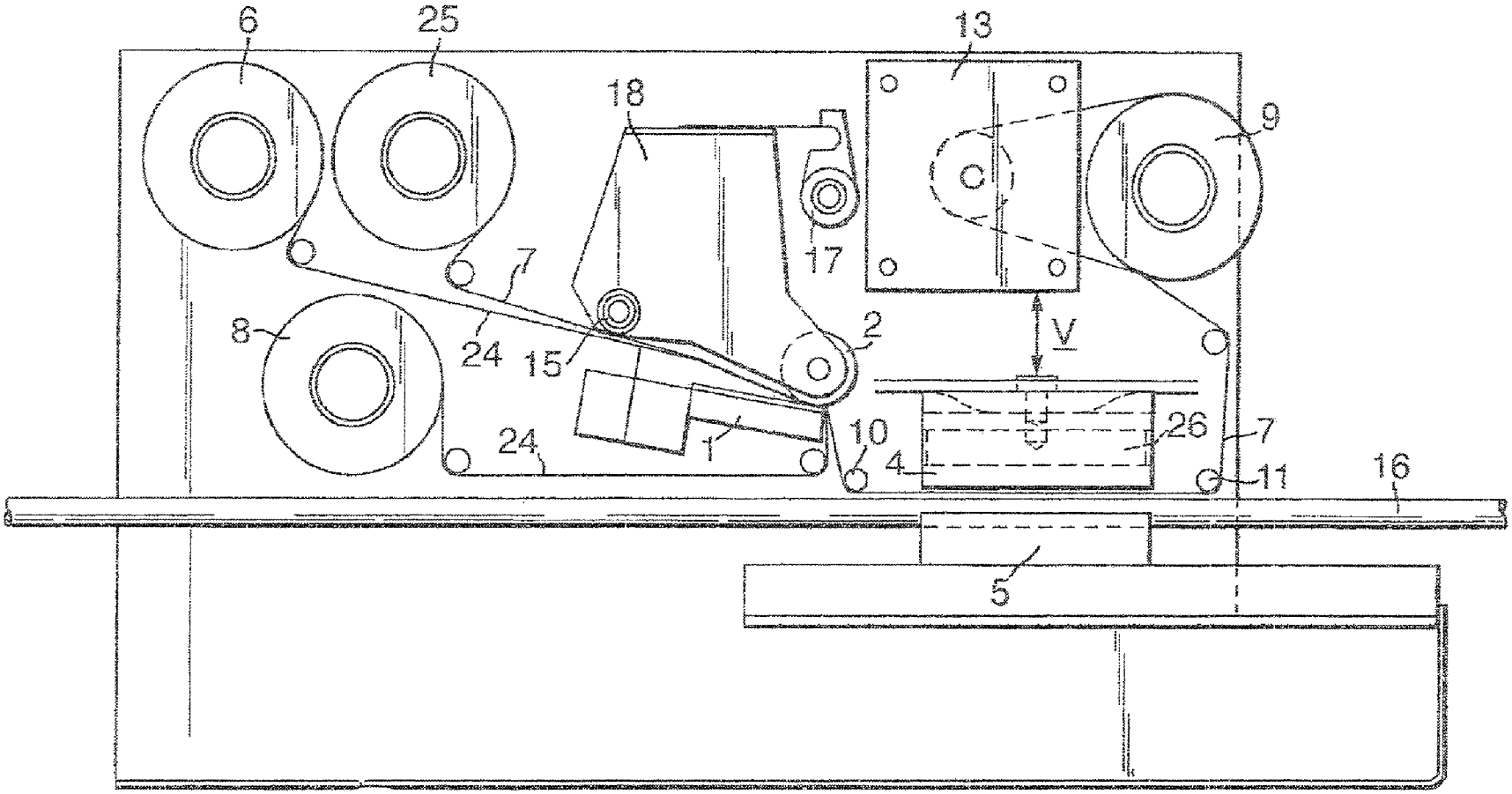
FIG. 2 is a schematic longitudinal view of a printing device according to the invention.
Figure 3:
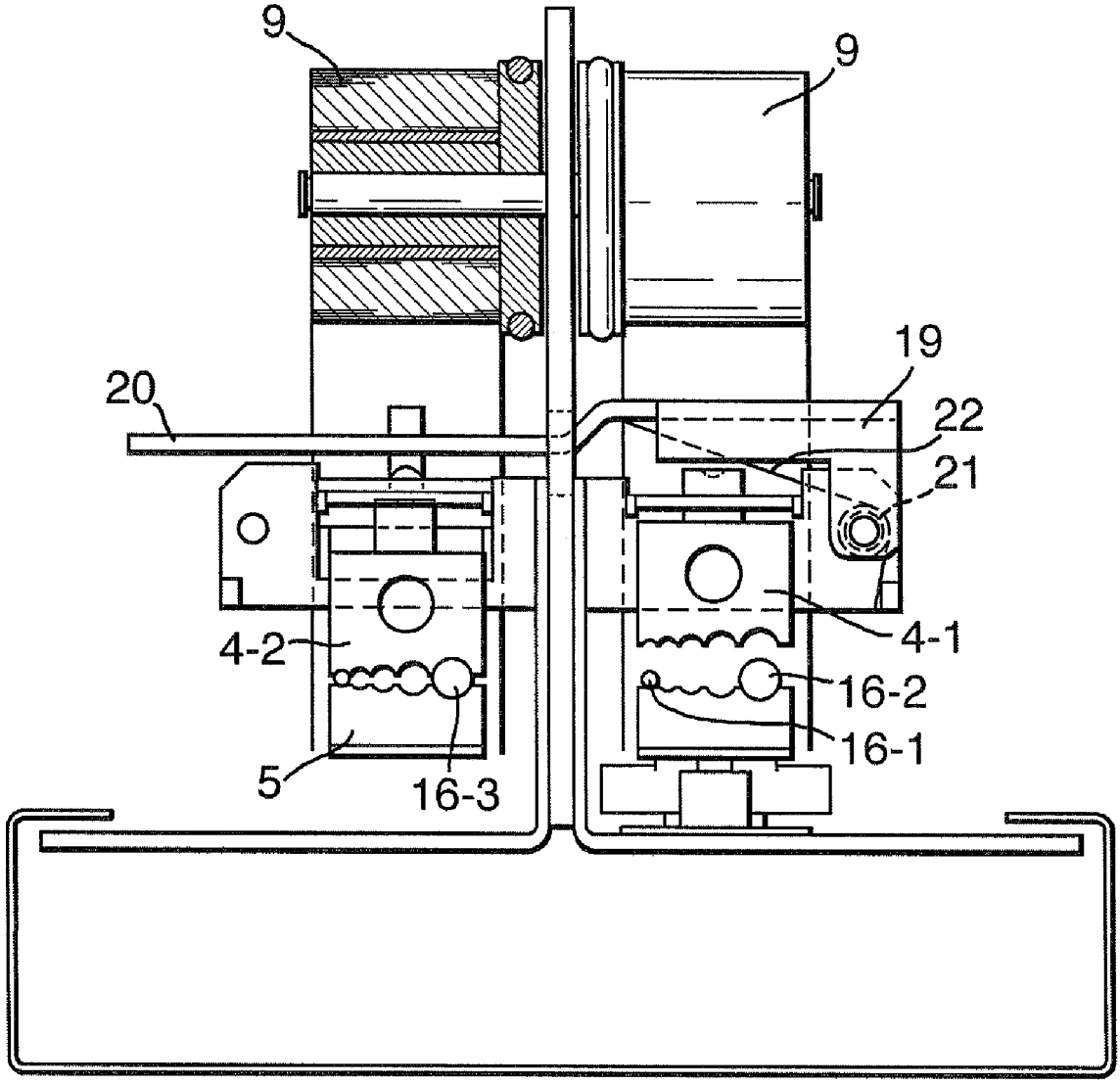
FIG. 3 is a schematic front view of a second exemplary embodiment of the printing device according to the invention having two adjacent printing units.

Two exemplary embodiments of the invention are shown in FIGS. 2 and 3 and are described in more detail below.

FIG. 2 is a view of a printing module with a thermal print head 1) and a printing roller 2). The printing roller 2) is fastened on a rocker 18) and is arranged to be rotatable around a bearing 15). The rocker 18) is biased with a catch 17) by means of a resilient contact pressure and the printing roller 2) is thus pressed against the thermal print head 1). A thermal transfer or colour band 24) is directed from a supply roll 6) between the printing roller 2) and the thermal print head 1) to a take-up roll 8). The retransfer band 7) is also directed from a supply roll 25) between the printing roller 2) and the thermal print head 1) and then further over guides 10) and 11) horizontally through the transfer device FIG. 1) between the upper die half 4) and the lower die half 5) onto a take-up roll 9). The two bands, the thermal transfer band and the retransfer band, are in contact between the thermal print head 1) and the printing roller 2), so that the marking is printed onto the retransfer band 7) in this region during transport of the two bands. The retransfer band 7) is transported by a motor drive 13) onto the take-up roll 9). After the marking has been printed onto the retransfer band 7), the retransfer band 7) is transported further into the correct position between the upper die half 4) and the lower die half 5). Simultaneously with the transport of the retransfer band 7) or transfer carrier, the thermal transfer or colour band 24) is transported and wound onto the take-up roll 8) by means of its own drive (not shown).

A heating cartridge 26) (FIG. 2) with a thermal sensor is inserted into the interior of the bore 12) of the upper die half 4) and is heated by an electrical supply and control means and held at a constant working temperature. The wire 16) to be printed on is shown in FIGS. 1 and 2. This wire 16) is located in the transfer device with the region to be printed located between the upper die half 4) and the lower die half 5). The upper die half 4 is moved downwards (shown here with arrow v) in order to transfer the marking from the retransfer band 7) onto the wire 16), wherein the retransfer band 7) sits snugly against the inner contour of the respective groove 3) and is thus laid around the upper half of the covering of the wire 16).

In a further view FIG. 3 shows of an exemplary embodiment with two printing units, which are arranged parallel to one another and serve to provide the parallel running print. Each of the two printing units can be fitted with a differently coloured transfer band, e.g. black and white, so that a contrasting marking can be applied to different coloured insulation by selecting the left or the right printing unit.

In the printing unit shown on the right, an upper die half 4-1) is located in the upper position. The printing and transport of the retransfer band 7 are conducted in this upper position, the resting position. In the printing unit shown on the left, an upper die half 4-2) is located in the lower position. The transfer printing of the marking from the retransfer band 7 onto a wire 16-1) to 16-3) occurs in this lower position. In addition, a lever 19) can be seen in FIG. 3. The lever 19) is disposed jointly with a wrap spring 22) to be rotatable around a bearing journal 21) and is pressed manually downwards onto the upper die half 4-2) by pressing at a location 20) against the spring pressure of the wrap spring 22). As a result, the upper die half 4-2) of the printing device shown on the left encloses the wire 16-3) to be printed jointly with the lower die half 5). In this position the two die halves 4-2) and 5) stand for a certain period of time under pressure against the wire 16-3) and transfer the marking onto the wire 16-3) under the simultaneous effect of heat of the upper die half 4-2).

As shown in FIG. 3, the die halves 4) and 5) have a plurality of parallel extending grooves with different diameters for differently sized outside diameters of the round wires. FIG. 3 shows an embodiment with five grooves for five different wire diameters. The wire to be printed on is inserted into the corresponding groove of the lower die half in accordance with its diameter, e.g. small wire diameter 16-1) and large wire diameter 16-2) in the right printing unit of FIG. 3.

The described printing process allows the complete marking to be printed in a simple and advantageous manner on individual insulated round wires in one printing operation using the thermal transfer printing method known per se. The marking is firstly printed onto the transfer carrier, i.e. a retransfer film, for example, with a thermal print head and a transfer film. In this case, the print of the marking is positioned on the retransfer film such that after the thermal transfer printing conducted by means of the thermal print head 1) and after transport of the retransfer film 7 into the transfer device, the marking is located above the wire 16 to be printed on and with the arrangement according to the invention is transferred onto the wire 16 in a second directly subsequent transfer printing operation.

For the transfer of the marking from the retransfer film 7) onto the wire surface, the retransfer film 7) is directed in keeping with the shape up to 180 degrees around the wire 16). The transfer device that comprises two parts, the upper and the lower die half 4) or 5), is provided for this. The lower die half 5 supports the wire 16) during the transfer printing, the upper die half 4 places the printed retransfer film 7 against the wire surface in keeping with the shape and transfers the printed marking from the retransfer film 7 onto the wire surface by means of pressure and heat.

The upper die half 4) encloses the wire surface up to 180° and therefore prints on the upper cylindrical surface of the wire contour. Inserted in the upper die half 4 is a heating system, which generates a temperature suitable for the transfer printing by means of an electronic control. The upper die half is held constantly at the working temperature and when the two die halves 4, 5 are placed together heats the printed-on retransfer film 7 and the surface of the insulation of the wire 16. This makes use of the advantage that the usual retransfer bands 7) are sufficiently flexible and—guided by the upper groove halves 3) of the upper die half 4)—sit snugly against the peripheral face of the wire 16) when the upper die half is lowered under light pressure onto the wire 16). Therefore, the invention allows the retransfer film 7) to be printed on along a substantially plane surface by means of the thermal print head 1) and also allows transfer of the printed markings onto the rounded wire surface by means of the upper die halves 4) having the grooves 3).

Figure 4:
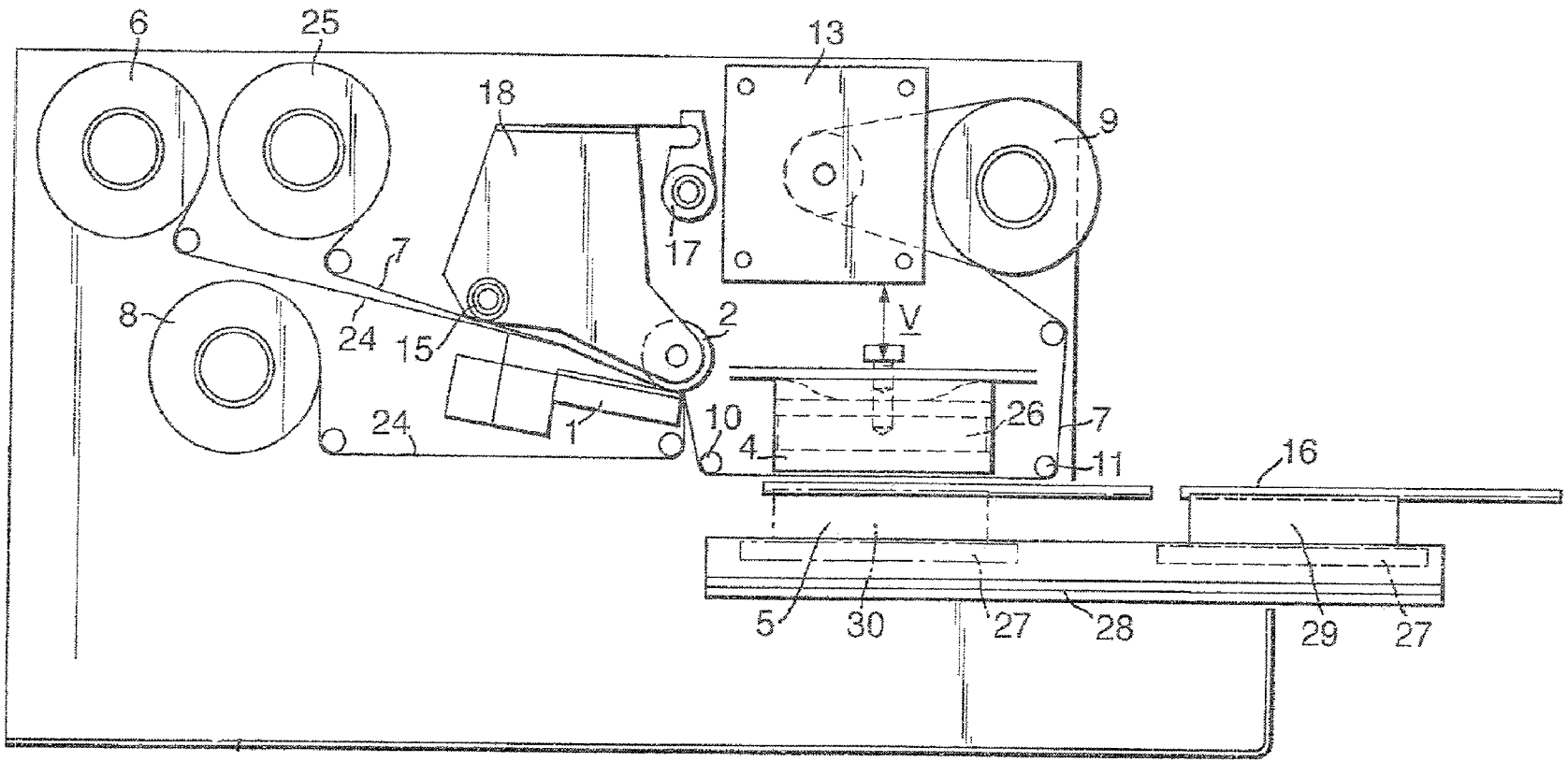
FIG. 4 shows a second exemplary embodiment of the printing device according to the invention in a view corresponding to FIG. 2.

For printing on wires 16-1 to 16-3 with different diameters, the die halves have a plurality of semicircular grooves 3 arranged next to one another, into which the wire 16 with the corresponding diameter is inserted for printing. The upper die half 4 is moved away upwards for insertion of the wire 16 to be printed on and thus frees the space for insertion of the wire 16 (FIG. 4). In this free space the retransfer band 7 is guided during printing in the longitudinal direction of the wire 16, in particular by means of guide rollers 10) and 11), for example, and at the end of the printing is located directly above the wire 16 and in the provided printing region of the wire 16. The retransfer band 7 is located on the roll 25) and is unwound from this and at the same time wound onto the take-up roll 9). Drive onto the take-up roll 9) is achieved with the motor drive 13). The marking 23 can be pressed against the printing roller 2) by the thermal print head 1) during the transport of the retransfer film 7).

In a particularly preferred embodiment, FIG. 4), hitherto considered to be the best of the invention, the lower die half 5) is mounted on a longitudinally displaceable slide 27, which can be moved manually or automatically back and forth along a slide guide rail 28, which in FIG. 1 preferably runs parallel to the wire 16). This enables the die half 5) to firstly be run out of the transfer device according to FIG. 1 with the slide 27 until it is arranged outside the device in a position 29. In this position 29, the lower die half 5 is freely accessible on the slide 27, so that the wire 16 to be printed on can be easily inserted into the groove 3 provided for it. The wire 16 is fastened on the lower die half 5 with a means (not shown), whereupon the slide 27 is run into the transfer device again in the transfer printing position shown in FIG. 2 and marked with the reference number 30 in FIG. 4. The die half 5) is then run out again, the printed-on wire removed and a new wire inserted. To assure a secure hold for the wires in the grooves 3) of the lower die half 5), this is preferably provided with elements such as clips, hooks, bands or the like for securing the wires 16). Such elements could also completely or partially replace the grooves in the lower die half 5).

During the movements of the slide 27, the upper die half 4 is respectively located in the upper position. In the exemplary embodiment with (two or more) printing unit according to FIG. 3 (two or more) slides 27 and a corresponding number of guide rails 28 that are preferably arranged parallel to one another are provided accordingly. This is shown in FIG. 3 for the right printing unit.

Alternatively, the lower die halves 5 could also themselves be configured as slides and be displaceably disposed on the guide rail 28.

The motors driving the colour and retransfer bands 24) and 7) are preferably connected into an electrical circuit in such a way that upon actuation of a pushbutton switch or the like, the two bands are transported further to such a distance as required for the subsequent transfer operation or for arrangement of the part of the retransfer band 7) provided with the markings in the transfer device.

The invention is not restricted to the described exemplary embodiments that can be modified in a wide variety of ways. This applies, for example, to the number of grooves 3) in the die halves 4) and 5), since in principle one groove 3) would be sufficient in each case to mark wires 16 with a preselected diameter. In this case, instead of round wires, wires with other, e.g. oval, cross-sections can also be printed on. For this reason, it can also be expedient to adapt the contours of the grooves 3 to the respective cross-sectional form of the wires 16. However, when using circular wires it is also advantageous to configure at least the contours of the grooves 3 in the upper die half 4 so that they are flattened towards the side (e.g. oval), and not round. As a result, for the insulation of the wires 16 that is generally made of PVC or rubber lateral spaces are created that allow the lateral material movement of the insulation material that occurs under the printing temperature. Moreover, it is clear that in FIG. 3 more than two printing units can also be arranged, if this is desired or necessary. Moreover, additional measures can be provided to further automate the printing operations including the insertion or changing of the wires as well as the displacement of the slide 27. It would also be possible to arrange the first die half 5) at the top and the second die half 4) at the bottom or the two die halves 4, 5) in FIG. 1 next to one another. Finally, it is understood that the different features can also be applied in combinations other than those described and represented.

It will be understood, that each of the elements described above or two or more together, may also find a useful application in other types of construction differing from the types described above.

While the invention has been illustrated and described as embodied in a printing device for round wires, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Printing device for printing markings (23) onto a covering of an insulated wire (16) and comprising a transfer device which contains a first die half (5) with first parallel grooves (3) to partially receive said wire (16), a second die half (4) with second parallel grooves (3) facing said first grooves and a heating device (26), said first and second grooves (3) lying next to one another in said first and second die half, respectively, and having different diameters such that wires of respective different diameters can be inserted into said die halves (4, 5), means for moving said two die halves (4, 5) against one another and a transfer carrier (7) which can be arranged between said wire (16) and said second die half (4) and which can be provided with said markings, wherein the arrangement is such that after said wire (16) is laid in said first die half and said transfer carrier (7) is arranged between said wire (16) and said second die half (4), said markings (23) are transferred to the covering by at least partially in said transfer carrier (7) around said covering of said wire (16) by moving said two die halves (4, 5) under pressure against one another and by heating said transfer carrier (7) and said covering with said heating device (26).

2. Printing device according to claim 1 and further comprising a printing module (1, 2) for printing said markings onto said transfer carrier (7) and a transport device (9, 24) for transporting said transfer carrier (7) into said transfer device.

3. Printing device according to claim 2, wherein said printing module (1, 2) contains a thermal printer (1) for printing on said transfer carrier (7).

4. Printing device according to claim 2, wherein two printing modules and transfer devices associated with these are arranged next to one another.

5. Printing device according to claim 1 and further comprising means (10, 11) for correctly positioning said transfer carrier (7) between said two die halves (4, 5).

6. Printing device according to claim 1, wherein said transfer carrier (7) is configured as a retransfer film.

7. Printing device according to claim 1, wherein said wire (16) is a round wire and wherein said first and second grooves (3) are substantially semicircular.

8. Printing device according to claim 7, wherein said grooves (3) of the second die half (4) each have a contour, which is flattened towards the sides.

9. Printing device according to claim 1, wherein said second die half (4) is movable against said first die half (5) by manual force by means of a lever system (19-22).

10. Printing device according to claim 1, wherein said second die half (4) is movable against the first die half (5) by a motive or pneumatic drive.

11. Printing device according to claim 1, further comprising means for inserting said wire (16) into and removing said wire (16) from said first die half (5), said means having a first die half (4) configured as a slide, which can be run into and out of the transfer device or mounted on such a slide (27).

* * * * *